United States Patent [19]

Kapoor

[11] Patent Number: 4,981,512

[45] Date of Patent: Jan. 1, 1991

[54] METHODS ARE PRODUCING COMPOSITE MATERIALS OF METAL MATRIX CONTAINING TUNGSTEN GRAIN

[75] Inventor: Deepak Kapoor, W. Paterson, N.J.

[73] Assignee: The United States of America as represented by the Secretary of the Army, Washington, D.C.

[21] Appl. No.: 567,474

[22] Filed: Jul. 27, 1990

[51] Int. Cl.[5] ..... B22F 9/00

[52] U.S. Cl. ..... 75/248; 419/23; 419/28; 419/31; 419/33; 419/35; 419/38; 419/49; 419/51

[58] Field of Search ..... 75/248; 419/23, 28, 419/31, 33, 35, 38, 49, 51

[56] References Cited

U.S. PATENT DOCUMENTS 3,762,026 10/1973 Shapiro ..... 419/1
3,779,745 12/1973 Rudy ..... 420/431
4,332,617 1/1982 Hovis, Jr. et al. ..... 419/34
4,793,969 12/1988 Johnson et al. ..... 75/248
4,885,028 12/1989 Kopatz et al. ..... 75/346

*Primary Examiner*—Stephen J. Lechert, Jr.
*Assistant Examiner*—N. Bhat
*Attorney, Agent, or Firm*—Robert P. Gibson; Edward Goldberg; Edward F. Costigan

[57] ABSTRACT

A composite material comprising a metal matrix containing tungsten grain is produced from tungsten powders formed by plasma rapid solidification. The powders comprise tungsten and up to 20 weight percent of a metal selected from the group consisting of molybdenum, tantalum, niobium, rhenium, and chromium. The surfaces of the powders are cleaned to reduce the surface oxide thereon, and the powders are coated with at least one metal selected from the group consisting of copper, nickel, cobalt, hafnium and tantalum. The coated powders are formed into a sintered preform which is less than fully dense, and the sintered preform is further consolidated to full density by a technique selected from hot isostatic pressing, rapid omin-directional compaction, and hot extrusion.

16 Claims, No Drawings

METHODS ARE PRODUCING COMPOSITE MATERIALS OF METAL MATRIX CONTAINING TUNGSTEN GRAIN

FIELD OF THE INVENTION

The present invention relates to methods for producing composite materials comprising a metal matrix containing tungsten grain. More specifically, the present invention relates methods for producing composite materials comprising a metal matrix containing tungsten grain which exhibit higher strengths and ductilities as compared with conventional tungsten heavy alloys.

BACKGROUND OF THE INVENTION

Tungsten heavy alloy materials are known in the art for use in various applications, including, among others, ballistic devices. In the past, tungsten heavy alloys have been fabricated by liquid phase sintering of mixed elemental powders. The material resulting from such liquid phase sintering generally comprises a two phase composite consisting of rounded tungsten grains dispersed in an alloy matrix. While resulting materials have exhibited sintered densities in excess of 99.5 percent of the theoretical density values, and high ductility and strength, it has been difficult to control the property uniformity and to consistently provide the maximum attainable properties.

Generally, the mechanical properties of the alloy materials are strongly dependent on the specific microstructural characteristics of the materials. The most prominent of these characteristics are the contiguity, the dihedral angle and the volume fraction of the tungsten phase. Ideally, for a given tungsten content, the optimal microstructure should exhibit low contiguity, a low dihedral angle, small grain size and strong tungsten-tungsten grain boundaries and tungsten-matrix interface. However, in practice, it appears that there is a clear tradeoff of these properties. For example, it appears that a low dihedral angle can be induced by higher tungsten solubility in the matrix phase which is possible through alloying or the use of higher sintering temperatures. Conversely, there is grain growth penalty owing to the use of higher sintering temperatures. Accordingly, it would be advantageous to provide a means for independently controlling the grain size, the dihedral angle and the contiguity.

Tungsten heavy alloy materials have also been produced using solid state sintering methods whereby finer microstructures, for example, of from two to three μm tungsten particle size, are obtained as compared with the liquid phase sintered products, having tungsten particle sizes of from 30 to 50 μm. However, solid state sintering provides materials having high contiguity and therefore the materials are extremely brittle. The use of very fine powders, for example, 0.1 μm in diameter, results in materials having a microstructure exhibiting low ductility.

Thus, a need exists for improved tungsten heavy alloy materials which have both fine grain size and low contiguity, and therefore exhibit both high strength and good ductility, and methods for the production of such materials.

SUMMARY OF THE INVENTION

Accordingly, it is an object of the present invention to provide methods for producing improved tungsten heavy alloy materials. It is a further object of the invention to provide methods for producing tungsten heavy alloy materials which exhibit fine grain size and low contiguity. It is another object of the invention to provide methods for producing tungsten heavy alloy materials which exhibit higher strengths and higher ductilities as compared with conventional tungsten heavy alloy materials prepared by liquid phase sintering methods. It is a related objective of the invention to provide improved tungsten heavy alloy materials which exhibit high strength and high ductility.

These and additional objects are provided by the methods according to the present invention for producing composite materials comprising a metal matrix containing tungsten grain. The methods according to the present invention comprise producing tungsten powders by plasma rapid solidification. The powders comprise tungsten and optionally up to about 20 weight percent of at least one metal selected from the group consisting of molybdenum, tantalum, niobium, rhenium and chromium. The surfaces of the powders are cleaned to reduce the surface oxide thereon, and the powders are coated with at least one metal selected from the group consisting of copper, nickel, cobalt, hafnium and tantalum. The coated powders are formed into a sintered preform which is less than fully dense, and the sintered preform is further consolidated to full density by a technique selected from hot isostatic pressing, rapid omni-directional compaction, and hot extrusion. The resulting product may be subjected to further thermomechanical processing if desired in accordance with such methods known in the art. The products of the present methods exhibit a fine grained microstructure, low contiguity and a uniform distribution of matrix metal around the tungsten grain. The composite materials therefore exhibit high strength and high ductility.

These and additional objects and advantages provided by the methods of the present invention will be more fully understood in view of the following detailed description.

DETAILED DESCRIPTION

The methods according to the present invention result in the production of a composite material comprising a metal matrix containing therein tungsten grain. The tungsten heavy alloy composite materials may be used in various applications, including, among others, in ballistic devices. The use of the composite materials resulting from the methods according to the present invention for kinetic energy penetrator application may substantially improve the ballistic performance of chemical and kinetic energy warheads.

According to the present methods, tungsten powders are produced by plasma rapid solidification techniques. These techniques are known in the art and generally produce powders having spherical morphology. It is believed that a spherical powder shape will assist in providing the composite material with lower contiguity and a more uniform distribution of the matrix metal. The tungsten powders produced by the plasma rapid solidification technique should have an average grain size of no greater than 20 μm. Additionally, the powders comprise from about 80 to 100 weight percent tungsten and from 0 to about 20 weight percent of at least one metal selected from the group consisting of molybdenum, tantalum, niobium, rhenium, and chromium. Thus, the powders may comprise pure tungsten or may comprise an alloy of tungsten and one or more of the recited metals.

According to the plasma rapid solidification technique, well-mixed metallic powder comprising from about 80 to about 100 weight percent tungsten and from 0 to about 20 weight percent of at least one alloying metal selected from the group consisting of molybdenum, tantalum, niobium, rhenium and chromium is fed by internal or external feed means into a thermal spray plasma gun, for example, a Baystate Model PG-100 plasma gun (Baystate Co., Westboro, Mass.) which has a power rating of 28 kilowatts and an internal feed nozzle. The ionized gas plume in a thermal spray plasma gun can reach temperatures of 10,000 Kelvin and is particularly suitable for melting tungsten, which has the highest melting point of any metal (3410° C.). The metallic powder is passed rapidly through the gas plume of the plasma gun, which plume may comprise ionized inert gases, such as argon, together with a small amount of helium or hydrogen. The powder melts almost instantaneously in the extremely hot gas plume, becoming a stream of molten metal droplets.

The molten metal is then sprayed in droplet form into a collecting chamber having an atmosphere composed of one or more relatively cool, inert gases, for example, argon, helium or nitrogen. The temperature of the atmosphere in the collecting chamber is preferably ambient or near-ambient, but may be any temperature low enough to cause rapid solidification of the metal droplets. The molten metal droplets solidify or "freeze" into tungsten alloy powder granules in the collecting chamber, and the powder is collected.

The tungsten powders resulting from the plasma rapid solidification are then subjected to surface cleaning to reduce surface oxide thereon. Preferably, the surface cleaning is effected by treating the powders in a hydrogen containing atmosphere.

After cleaning, the tungsten powders are coated with at least one metal selected from the group consisting of copper, nickel, cobalt, hafnium and tantalum. The coating metal or metals will form the matrix of the composite material. The coating may be performed by one of various methods known in the art including, for example, chemical vapor deposition or plasma vapor deposition. An important feature of the coating step is that each powder particle is uniformly and homogeneously coated without agglomeration of the powders during the coating process.

The coated powders are then formed into a sintered preform which is less than fully dense, full density being the theoretical density of the material. In one embodiment, the sintered preform is formed by cold compacting of the coated powders, for example using isostatic pressing, and then sintering the cold compact, for example at a temperature of from about 1000° C. to about 1350° C. In an alternate embodiment, the sintered preform may be formed by loose sintering of the coated powders under a hydrogen-containing atmosphere.

Finally, the sintered preform is further consolidated to full density by, for example, hot isostatic pressing, rapid omni-directional compaction, or hot extrusion, all of which techniques are well known in the powder metallurgical art. If desired, the fully dense compact may further be subjected to thermomechanical processing, for example, extrusion, swaging, rolling or the like, in accordance with such methods which are known in the art.

The fully consolidated composite materials produced according to the methods of the present invention exhibit a fine-grained microstructure, low contiguity, and a uniform distribution of matrix around tungsten grain. The composite materials exhibit both higher strengths and ductilities as compared with tungsten-heavy alloy materials produced according to the conventional liquid-phase sintering methods.

The following Example demonstrates the methods and composite materials according &o the present invention.

EXAMPLE

In this Example, commercially available tungsten powder of Grade C-10 was blended with fine molybdenum powder. The mixture contained about 95 weight percent of the tungsten powder and about 5 weight percent of the molybdenum powder. The blended mixture was agglomerated using a commercially available binder such as PVA. The agglomerated powder was fed through the hot plume of a plasma gun (Metco 9M model). The resulting super heated powder was then rapidly cooled at a cooling rate of greater than $10^{5}$° C./sec, and was collected in an inert atmosphere chamber. The resulting powder exhibited a spherical morphology and an average particle size of less than 20 μm. X-ray diffraction and metallographic examination disclosed that the powder contained the tungsten and molybdenum in the 95:5 weight percent proportion of the original powder mixture. The powder was then reduced at 800° to 1,000° C. for four hours under a flowing hydrogen atmosphere in order to remove surface oxide therefrom. The resulting cleaned powder was coated with from about 3 to about 7 weight percent of nickel at 600° to 900° C. using a modified chemical vapor deposition process. The resulting coated powder was then cold isostatically compacted in a rod form to approximately 75% of its theoretical density. The compacted rods were presintered at 1300° to 1400° C. for one hour under a reducing atmosphere. The resulting presintered rods were then encapsulated in stainless steel cans and hot extruded at 1200° C. This produced a fully dense rod which exhibited a fine grained and homogeneous microstructure. The fully dense rods were then further thermomechanically processed by a hot swaging process at 700° to 900° C.

The preceding detailed description and example are set forth to illustrate specific embodiments of the invention and are not intended to limit the scope of the methods and products of the present invention. Additional embodiments and advantages within the scope of the claimed invention will be apparent to one of ordinary skill in the art.

What is claimed is:

1. A method for producing a composite material comprising a metal matrix containing tungsten grain, which method comprises the steps of:

(a) producing tungsten powders by plasma rapid solidification, said powders comprising from about 80 to 100 weight percent tungsten and from 0 to about 20 weight percent of at least one metal selected from the group consisting of molybdenum, tantalum, niobium, rhenium, and chromium;

(b) cleaning the surfaces of the tungsten powders and reducing surface oxide thereon;

(c) coating the tungsten powders with a coating comprising at least one metal selected from the group consisting of copper, nickel, cobalt, hafnium and tantalum;

(d) forming the coated powders into a sintered preform which is less than fully dense; and (e) further consolidating the sintered preform to full density by a technique selected from the group consisting of hot isostatic pressing, rapid omni-directional compaction, and hot extrusion.

2. A method for producing a composite material as defined by claim 1, wherein the resulting composite material is subjected to thermomechanical processing.

3. A method for producing a composite material as defined by claim 1, wherein the tungsten powders produced by plasma rapid solidification have an average grain size of not greater than 20 μm.

4. A method for producing a composite material as defined by claim 1, wherein the tungsten powders produced by plasma rapid solidification consist of tungsten.

5. A method for producing a composite material as defined by claim 1, wherein the tungsten powders produced by plasma rapid solidification comprise tungsten and at least one metal selected from the group consisting of molybdenum, tantalum, niobium, rhenium, and chromium.

6. A method for producing a composite material as defined by claim 1, wherein the surfaces of the tungsten powders are cleaned by treating the tungsten powders in a hydrogen atmosphere.

7. A method for producing a composite material as defined by claim 1, wherein the tungsten powders are coated by chemical vapor deposition of at least one metal selected from the group consisting of copper, nickel, cobalt, and tantalum.

8. A method for producing a composite material as defined by claim 1, wherein the tungsten powders are coated by plasma vapor deposition of at least one metal selected from the group consisting of copper, nickel, cobalt, hafnium and tantalum.

9. A method for producing a composite material as defined by claim 1, wherein the sintered preform is formed by cold compacting the coated powders and sintering the compacted powders.

10. A method for producing a composite material as defined by claim 9, wherein the coated powders are compacted by isostatic pressing.

11. A method for producing a composite material as defined by claim 9, wherein the compacted powders are sintered at a temperature from about 1000° C. to 1350° C.

12. A method for producing a composite material as defined by claim 1, wherein the sintered preform is formed by loose sintering under a hydrogen-containing atmosphere.

13. A method for producing a composite material as defined by claim 1, wherein the sintered preform is further consolidated to full density by hot isostatic pressing.

14. A method for producing a composite material as defined by claim 1, wherein the sintered preform is further consolidated to full density by rapid omni-directional compaction.

15. A method for producing a composite material as defined by claim 1, wherein the sintered preform is further consolidated to full density by hot extrusion.

16. A composite material comprising a metal matrix containing tungsten grain, formed by a method comprising the steps of:

(a) producing tungsten powders by plasma rapid solidification, said powders comprising from about 80 to 100 weight percent tungsten and from 0 to about 20 weight percent of at least one metal selected from the group consisting of molybdenum, tantalum, niobium, rhenium, and chromium;

(b) cleaning the surfaces of the tungsten powders and reducing surface oxide thereon;

(c) coating the tungsten powders with a coating comprising at least one metal selected from the group consisting of copper, nickel, cobalt, hafnium and tantalum;

(d) forming the coated powders into a sintered preform which is less than fully dense; and (e) further consolidating the sintered preform to full density by a technique selected from the group consisting of hot isostatic pressing, rapid omni-directional compaction, and hot extrusion.

* * * * *